US005715995A

United States Patent [19]

Huskey

[11] Patent Number: 5,715,995

[45] Date of Patent: Feb. 10, 1998

[54] ROTATABLE MAILBOX ARM WITH INDICATOR

[76] Inventor: Claudis C. Huskey, 413 Carson Dr., Gaffney, S.C. 29340

[21] Appl. No.: 568,251

[22] Filed: Dec. 6, 1995

[51] Int. Cl.[6] ..... B65D 91/00

[52] U.S. Cl. ..... 232/34

[58] Field of Search ..... 232/34, 35; 116/215, 116/175, DIG. 3, DIG. 13, 306, 307; 74/494.4, 494.5

[56] References Cited

U.S. PATENT DOCUMENTS

| | | | |
|---|---|---|---|
| D. 361,195 | 8/1995 | Suta | 232/34 X |
| 743,297 | 11/1903 | Lawrence | 232/34 |
| 1,834,296 | 12/1931 | Talke et al. | 74/594.5 |
| 2,573,042 | 10/1951 | Minovitz | 116/306 X |
| 3,827,627 | 8/1974 | Clement | 232/35 |
| 4,313,352 | 2/1982 | Okajima | 74/594.4 |
| 4,429,950 | 2/1984 | Zwahlen | 74/594.4 X |
| 4,700,588 | 10/1987 | Nagano | 74/594.4 |
| 5,445,317 | 8/1995 | Sokolowski | 232/34 |

FOREIGN PATENT DOCUMENTS

| | | | |
|---|---|---|---|
| 176961 | 5/1935 | Germany | 116/306 |
| 192406 | 11/1964 | Sweden | 116/306 |

*Primary Examiner*—Jerry Redman
*Attorney, Agent, or Firm*—Michael A. Mann, P.A.

[57] ABSTRACT

A rotatable mailbox arm having a rotatable indicator carried by its distal end. The indicator, such as a disk that carries information, a reflector, a decoration or advertising, is attached to the arm from an off center point on its rear surface so that it rotates in a direction counter to the rotation of the arm. Counter rotation of the indicator maintains the orientation of the indicator so that what is carried on it is in its normal orientation regardless of the position of the mailbox arm.

2 Claims, 2 Drawing Sheets

ROTATABLE MAILBOX ARM WITH INDICATOR

BACKGROUND OF THE INVENTION

1. Field of the Invention

The present invention relates to mailboxes. More specifically, the present invention relates to an indicator rotatably carried by a mailbox arm.

2. Discussion of Background

"Flags" or arms are carried on the exterior of rural mailboxes. These flags rotate from a horizontal to a vertical position. When in the vertical position, the flag serves to indicate to a mail carrier that a mailbox contains mail for the carrier to pick up for delivery.

Mailboxes are frequently decorated by their owners. However, federal regulations prohibit the mailbox owner from applying advertisements to the mailbox. However, no regulations apply to the flags. Thus, the owner could theoretically decorate or apply advertising to the flags. However, these flags are small and, when rotated from a horizontal to a vertical position, the decoration or advertising would be rotated as well. Thus, flags on mailboxes are generally unsuitable as a surface for advertising, although it is known to apply decorations to the arms.

Prior to the instant invention, there exists no mailbox arm carrying an indicator that maintains its orientation when the arm is rotated.

SUMMARY OF THE INVENTION

According to its major aspects and briefly stated, the present invention is a rotating mailbox arm carrying an indicator at its distal end. The indicator is attached to the arm so that it rotates freely and so that it maintains the same orientation regardless of the position of the arm, preferably attaching it to the arm at a point away from its center of gravity so that its weight is used to maintain its orientation. The indicator may carry written information such as the address or name of the mail box owner, a device such as a reflector, advertising such as a team logo, or may simply be decorated. Hereinafter, information, a device, advertising, and a decoration carried by the indicator will be referred to as a "legend."

The attachment of an indicator to the arm is a major feature of the present invention. The attachment of an indicator gives a larger surface on which to apply decorations or advertising or other types of legends. This feature enables those who want to decorate their mailbox greater possibilities for doing so.

The attachment of a rotatable indicator to the arm from an off center point on the indicator is another major feature of the present invention. When the arm is rotated from the horizontal to the vertical position, the indicator counter-rotates so that its center of gravity is directly below the point of attachment, thus preserving and maintaining the orientation of the indicator. Therefore, the legend carried by the indicator will remain in the same orientation with respect to the viewer; it may have rotated about the same axis as the arm—because the arm rotated and it is attached to the arm—but it has not rotated about its own axis.

Other features and advantages will be apparent to those skilled in the art from a careful reading of the detailed description of a preferred embodiment accompanied by the following drawings.

DETAILED DESCRIPTION OF A PREFERRED EMBODIMENT

Figure 1:
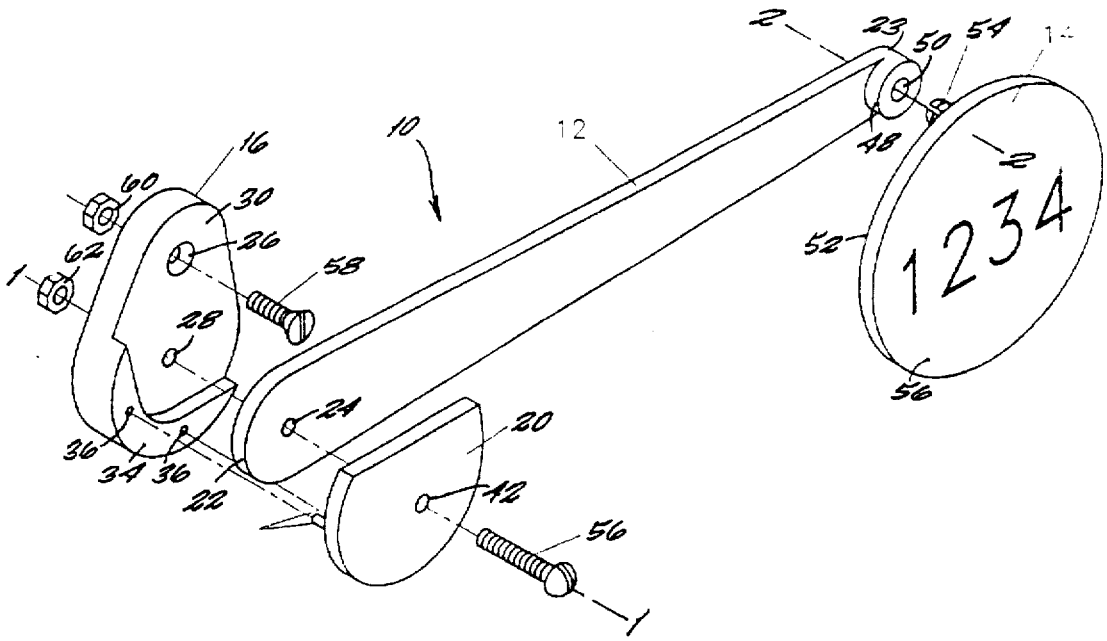
FIG. 1 is a exploded, perspective view of a device according to a preferred embodiment of the present invention.

The present invention is a mailbox arm with an indicator carried by its distal end, preferably a rotatable indicator and most preferably, an indicator that maintains its orientation regardless of the rotation of the arm to which it is attached. FIG. 1 shows the device in perspective and generally indicated by reference numeral 10. Device 10 comprises a rotating arm 12, an indicator 14, a mounting plate 16, and a front plate 20. Arm 12 has a first end 22 and an opposing second end 23. Device 10 can be made of any material that is durable and water resistant. These materials include, but are not limited to, certain metal alloys and polymers.

Figure 2:
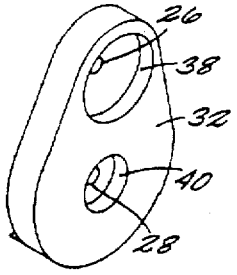
FIG. 2 is a rear, perspective view of a mounting plate according to a preferred embodiment of the present invention.
Figure 3:
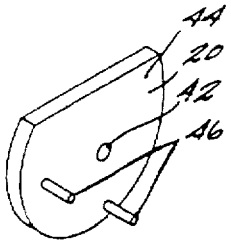
FIG. 3 is a rear, perspective view of a front plate according to a preferred embodiment of the present invention.

Proximate to first end 22 of rotating arm 12 is a throughhole 24. Mounting plate 16 is fitted with a first throughhole 26 and a second throughhole 28. Extending from front face 30 of mounting plate 16 is a shoulder 34. Shoulder 34 is fitted with pinholes 36. Rear face 32 of mounting plate 16 has two annular recesses 38 and 40, as shown in FIG. 2. Annular recesses 38 and 40 are formed to engage convex dimples formed on the exterior side of some mailbox models. Front plate 20 is fitted with a throughhole 42. Rear face 44 of front plate 20 has pins 46 extending therefrom, as shown in FIG. 3.

Figure 4:
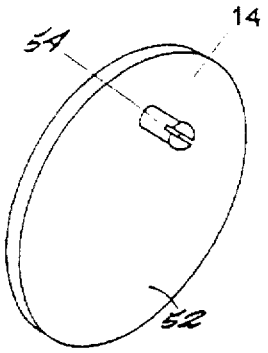
FIG. 4 is a rear, perspective view of an indicator according to a preferred embodiment of the present invention.
Figure 5:
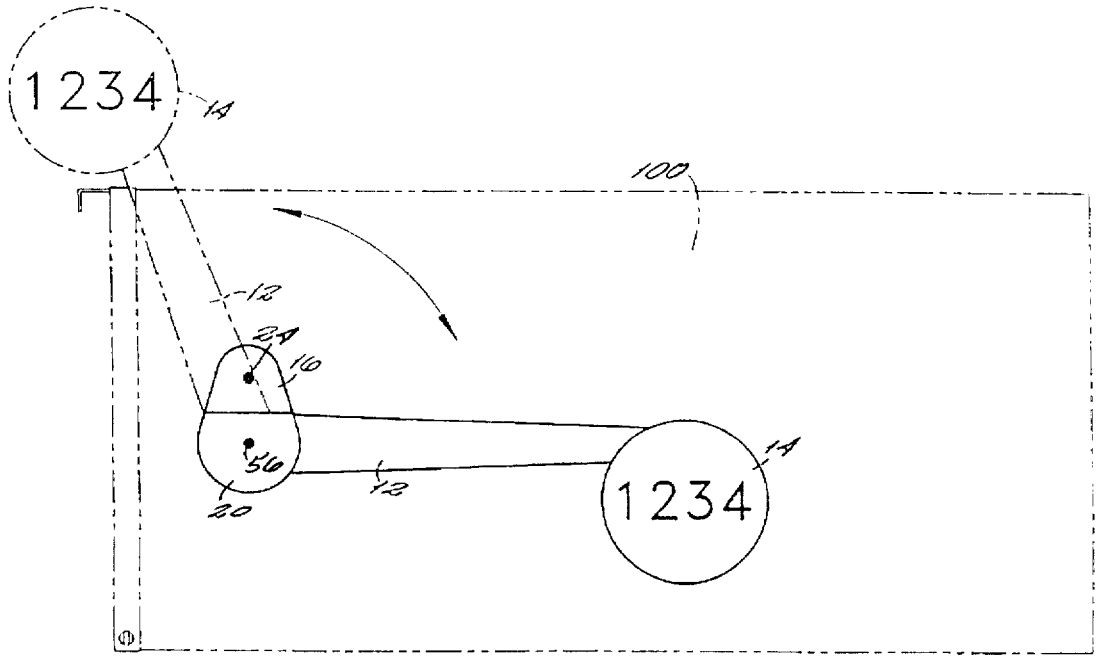
FIG. 5 is a front view of a device according to a preferred embodiment of the present invention mounted on a mailbox suggested by dashed lines.

Second end 23 of rotating arm 12 is formed with an annular projection 48 having a throughhole 50. Rear surface 52 of indicator 14 is equipped with an expansion pin 54, as shown in FIG. 4. Expansion pin 54 extends from an off center point on rear surface 52 so that the center of gravity of indicator 14 is spaced apart from the point of attachment to arm 12. As a result of this off center attachment, indicator 14, if left to rotate freely, will rotate so that its center of gravity will be directly below expansion pin 54; that is, the center of gravity of indicator 14 will lie along a vertical line that passes through expansion pin 54 with the center of gravity below expansion pin 54. This orientation of indicator 14 is its normal orientation and one that the present invention will maintain regardless of movement of arm 12. Indicator 14 is illustrated as a circular disk, however, indicator 14 may assume other shapes, including rectangular or square plates and shields. A legend may be placed on front surface 56 of indicator 14 as illustrated in FIGS. 1 and 5 by the numerals "1234" suggesting a house number.

Alternatively, indicator 14 can be weighted so that pin 54 can be attached to the geometric center or other part of indicator 14 to space the center of gravity apart from the point of attachment, and indicator 14 will still rotate so that its center of gravity is below the point of attachment.

To assemble device 10, first end 22 of rotating arm 12 is positioned against front face 30 of mounting plate 16 so arm 12 rests against shoulder 34. Rear face 44 of front plate 20 is then placed against arm 12, with pins 46 being received by pinholes 36 of shoulder 34. At this point, throughhole 42 of front plate 20 will be aligned with throughhole 24 of arm 12 and throughhole 28 of mounting plate 16. A bolt 56 is then threaded through throughholes 42, 24 and 28 and through a hole in a mailbox. A second bolt 58 is threaded through hole 26 and through a second hole in the mailbox. Nuts 60 and 62 are then threaded on bolts 56 and 58, respectively, to thereby fasten device 10 to a mailbox. When in place, arm 12 can rotate about the horizontal axis denoted by line 1—1 of FIG. 1. Alternatively, other fasteners commonly employed in the art may be used in lieu of the illustrated nut and bolt arrangements without departing from the spirit and scope of the invention. Such fasteners include, but are not limited to pins and clips.

Indicator 14 is then placed in position by inserting expansion pin 54 through throughhole 50 of annular projection 48 on second end 23. When in place, indicator 14 will be free to rotate about the horizontal axis denoted by line 2—2 in FIG. 1. It is understood that other mechanisms which enable the rotation of indicator 14 may be substituted for expansion pin 54 or pin 54 may be attached to arm 12 rather than indicator 14. Such mechanisms include, but are not limited to spring pins, bolts and dowels.

Referring now to FIG. 5, when mounted on mailbox 100, rotating arm 12 can be rotated about axis 1—1 between an angle of approximately 0° and 120°, which in the movement of the arm are referred to as "horizontal" and "vertical," respectively. The rotation of arm 12 is restricted to between 0° and 120° by shoulder 34. When arm 12 is rotated about axis 1—1, for example in a counterclockwise direction, from horizontal to vertical, indicator 14 will counter-rotate—in a clockwise direction—about an axis through pin 54 so that its center of gravity is always directly below expansion pin 54 and its orientation with respect to the viewer is maintained; that is, the legend will counter-rotate only enough to maintain the normal orientation of indicator 14. Conversely, a clockwise rotation of arm 12 will result in a counterclockwise rotation of indicator 14. Consequently, the orientation of indicator 14 is maintained, thereby ensuring that the legend imprinted on front surface 56 of indicator 14 remains legible.

It will be apparent to those skilled in the art that many modifications and substitutions can be made to the preferred embodiment just described without departing from the spirit and scope of the invention as defined in the appended claims.

What is claimed is:

1. A device, comprising:

a mailbox;

an arm having a first end and an opposing second end;

means for mounting said first end of said arm to said mailbox so that said arm can rotate between a horizontal position and a vertical position;

an indicator carrying a legend; and means for attaching said indicator to said arm, said attaching means attaching said indicator to said arm so that said indicator counter-rotates when said arm is rotated between said horizontal position and said vertical position.

2. The device as recited in claim 1, wherein said indicator is attached to said second end of said arm.

* * * * *